United States Patent [19]

Krolak

[11] 4,359,133

[45] Nov. 16, 1982

[54] RESILIENT SUPPORT FOR ELECTRONIC COMPONENT

[75] Inventor: Leo V. Krolak, Plantation, Fla.

[73] Assignee: Motorola, Inc., Schaumburg, Ill.

[21] Appl. No.: 295,403

[22] Filed: Aug. 24, 1981

Related U.S. Application Data

[63] Continuation of Ser. No. 135,064, Mar. 28, 1980, abandoned.

[51] Int. Cl.[3] ..... H04R 1/02; B65D 55/00

[52] U.S. Cl. ..... 181/172; 181/148; 16/2

[58] Field of Search ..... 181/148–156, 181/171, 172, 199; 179/146 E, 1 E; 16/2

[56] References Cited

U.S. PATENT DOCUMENTS

| | | | |
|---|---|---|---|
| 1,371,337 | 3/1921 | Whittington | 248/27.1 |
| 2,244,977 | 6/1941 | Hansman et al. | 16/2 |
| 2,623,431 | 12/1952 | Scheurmann | 85/13 |
| 3,011,743 | 12/1961 | Heath | 248/27.1 |
| 3,361,400 | 1/1968 | Webb | 248/27.1 |
| 3,516,111 | 6/1970 | Heyman | 16/2 |
| 3,674,295 | 7/1972 | Padovani | 292/76 |
| 4,161,995 | 7/1979 | Pohlmann et al. | 181/199 |

*Primary Examiner*—Richard A. Wintercorn
*Assistant Examiner*—Thomas H. Tarcza
*Attorney, Agent, or Firm*—Donald B. Southard; Edward M. Roney; James W. Gillman

[57] ABSTRACT

An electronic component, such as a speaker, is supported on the chassis of an electronic device, such as a small radio pager, by a resilient annular member which is latched to the chassis. The annular member has an inner surface for receiving a part of the component, such as the speaker pot, and a plurality of fingers extending from the member and inserted through an opening in the chassis with outwardly extending hook-like ends which engage the opposite side of the chassis. The member and fingers are flexible for mounting on the chassis, and are rendered more rigid when the component is inserted therein so that the fingers hold the member on the chassis. The annular member may include portions which are flexed when the component is placed therein to store energy which tends to move the component out of the member. When used for supporting a speaker, the member tends to move the speaker pot to hold the speaker edge against a grill which may be formed in the housing of the device. The component support is self-aligning and self-centering and facilitates assembly of the component on the chassis.

4 Claims, 4 Drawing Figures

RESILIENT SUPPORT FOR ELECTRONIC COMPONENT

This is a continuation, of application Ser. No. 135,064, filed Mar. 28, 1980 now abandoned.

BACKGROUND OF THE INVENTION

In small electronic devices, such as a radio pager, it is difficult to mount a large component, such as a speaker, so that it is in the proper position and does not take an unnecessarily large space. Screws and clamps have been used, but they have made assembly of the components difficult. The speaker edge or lip must engage the grill through which the sound passes for proper operation, but if the speaker is assembled to the grill, which may be part of the housing, this may interfere with the assembly of the chassis or other components in the housing. This is particularly true where the speaker is relatively large compared to the entire device. The speaker may be assembled to the chassis, but when the chassis is placed in the housing, the speaker may not engage the grill because of the tolerances in the dimensions of the various parts.

SUMMARY OF THE INVENTION

It is an object of this invention to provide an improved mounting for a component in a miniature electronic device.

A further object of the invention is to provide a resilient, shock isolating, self-centering and self-aligning mounting for a speaker in a small radio device.

A still further object is to provide an electrical insulating mounting for a speaker on the chassis of a radio device which resiliently holds the speaker edge in proper position against a grill which may be formed in the housing of the device.

Another object is to provide a resilient annular member for mounting a component on a chassis which has fingers with hooks thereon insertable through an opening in the chassis and held in latching position when the component is placed therein.

A mounting for a speaker or other component in a miniature radio, such as a pager, includes a resilient annular member for receiving at least a part of the component, and fingers extending therefrom into an opening in the chassis or other support. The annular member has parts around the outside engaging one side of the chassis and the fingers have hooks on the ends which engage the other side. The member is resilient so that the fingers can be flexed for insertion into the opening and is stiffened when the component is placed therein so that the fingers hold the member and component on the support. Parts of the member are shaped to be flexed when the component is placed therein to store energy to tend to move the component outwardly from the support. When used to support a speaker, the member tends to move the same to hold the speaker edge against a grill for proper acoustical operation. The parts can be chord sections of the annular member, which engage an end of the component, or arms extending from the member which engage a rim of the component.

The support can be molded of resilient electrically insulating plastic material to thereby insulate the component from conductors and/or other components on the chassis. The resilient member and fingers provide a shock isolating, self-centering and self-aligning action, and facilitate the mounting of a speaker on a chassis so that it is properly positioned with respect to a grill formed in the housing.

DETAILED DESCRIPTION OF THE INVENTION

Figure 1:
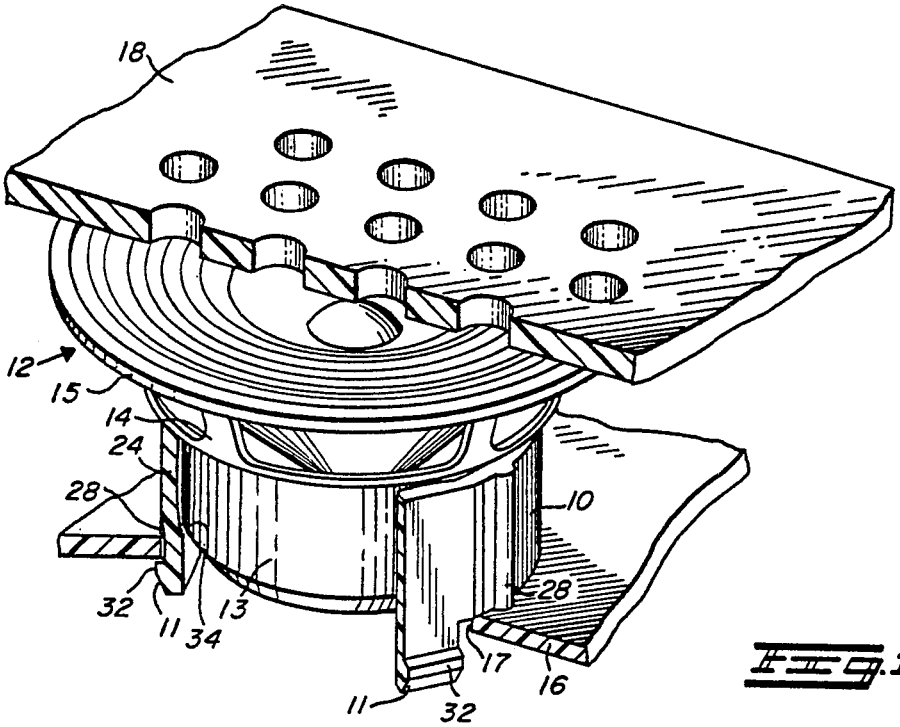
FIG. 1 is a perspective view, partly in section, showing the speaker support used in a device.

FIG. 1 shows the speaker support 10 supporting a speaker 12 on a chassis 16, of an electronic device. The speaker has a pot 13 extending within the support 10, and a basket 14 having an edge 15 which is held against a grill 18. The grill 18 can be part of a housing within which the chassis 16 is supported. The support 10 includes projecting fingers 11 which extend through an opening 17 in the chassis 16 to hold the support 10 and speaker 12 mounted thereto.

Figure 2:
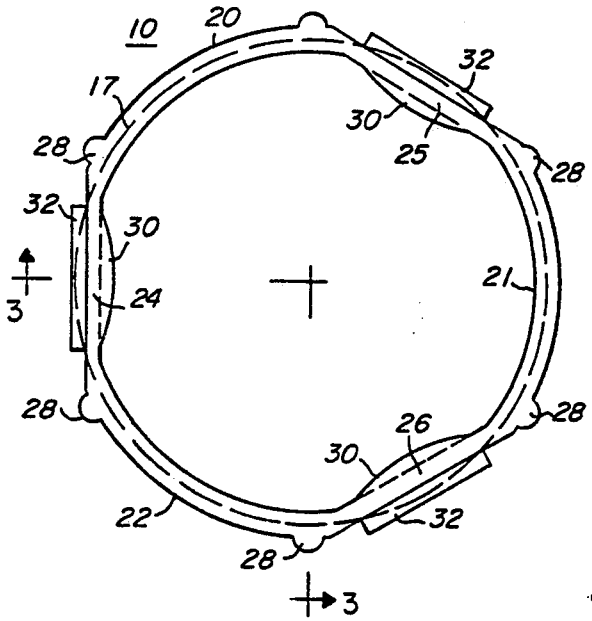
FIG. 2 is a plan view of the speaker support.
Figure 3:
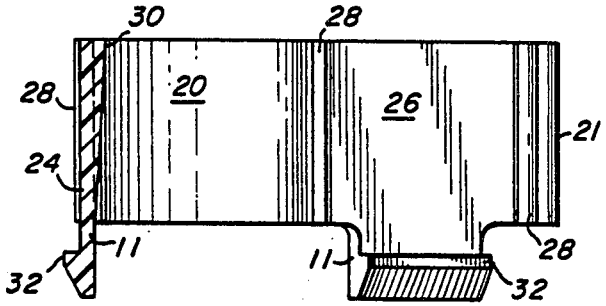
FIG. 3 is a view along the lines 3—3 of FIG. 2.

FIGS. 2 and 3 show the construction of the speaker support 10 in detail. The support can be made of a material such as an acetal homopolymer or copolymer which is resilient and electrically insulating. The member 10 is generally annular with three portions 20, 21 and 22 which are arcs of a circle, and three portions 24, 25 and 26 which are chords. Joining the arcs and chords are ribs 28 which extend along the member 10. The chords may have inwardly curved sections 30 at the top to compensate for variations in the size of the speaker pot or other component which it supports. The term annular as applied to the support member 10 is not to be limited to a round member, as the member 10 is not precisely round as shown by FIG. 2. Other variations from round may be used in a member for supporting a component.

FIG. 2 shows the opening 17 in the chassis 16 by dotted line 17, and shows the relation of the member 10 to this opening when the member 10 is positioned on the chassis 16. It will be apparent that the arc portions 20, 21 and 22 and the ribs 28 have an outward extent greater than that of the opening 17 so that these portions will rest on the chassis 16 about the opening. The fingers 11 have hooks 32 on the ends thereof which extend outwardly to engage the bottom side of the chassis 16, as shown in FIG. 1. The fingers 11 extend from the chord portions 24, 25 and 26, and it will be apparent from FIG. 2 that these portions will have to flex to permit the hooks 32 to pass through the opening 17. However, the plastic material used for member 10 is sufficiently flexible that this is easily accomplished. When the speaker pot 13 is positioned within the member 10, the chord portions 24, 25 and 26 will be flexed outwardly and this will make the member 10 more rigid so that the fingers 11 are held in position with the hooks 32 thereon engaging the opposite or bottom side of the chassis 16. This will hold the member 10 in position and provide a secure mounting for the speaker 12.

As stated above, the speaker pot 13 will cause the chord sections 24, 25 and 26 to flex or curve outwardly. This will store energy as member 10 will try to assume its original configuration with the chord portions being flat. This will produce a force from the chord portions 24, 25 and 26 against the bottom edge 34 of the speaker pot 13, as illustrated in FIG. 1. This force will tend to move the speaker pot 13 upward so that the speaker edge 15 engages the bottom side of the grill 18. This makes it possible to assemble the speaker 12 on the chassis 16 and then place the chassis in a housing, with the speaker edge 15 being held in engagement with the grill 18. The mounting member 10 is self-centering and self-aligning by the resilient engagement of the fingers 11 within the opening 17 of the chassis 16, and eliminates the need for screws, clamps or other holding means.

Figure 4:
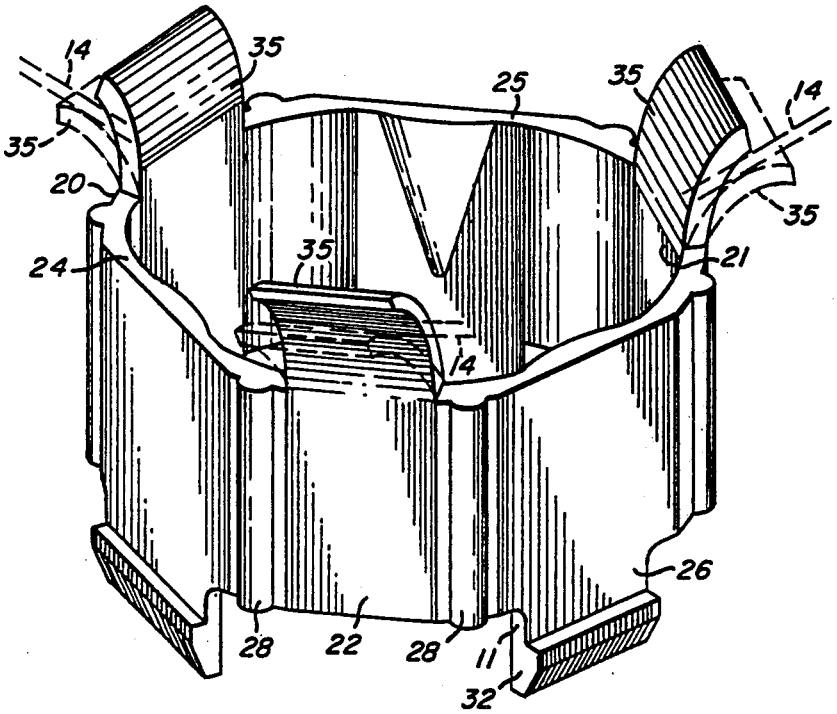
FIG. 4 illustrates a second embodiment of the support of the invention.

In some cases, the speaker used may have a pot which is longer than that shown in FIG. 1 and may extend into or through the opening 17 in the chassis 16. In such case, the chord sections of the support member will not provide a force to move the speaker upwardly against the grill 18. For use in such cases, the annular member 10 can have a plurality of arms 35 extending upwardly as shown in FIG. 4. The arms 35 will be engaged by the basket 14 of the speaker when the speaker pot is inserted in the member, and will be flexed downward to store energy. The basket 14 and flexed position of the arms 35 is shown by dotted lines in FIG. 4. This deflection of the cantilever arms 35 will provide an upward force to hold the edge 15 of the speaker against a grill 18 in the housing as shown by FIG. 1. As shown in FIG. 4, the arms 35 may extend from the arc-like sections of the annular member 10.

The structure described provides an inexpensive mounting for a speaker or the like in a very small electronic device. Since the mounting is inserted into an opening in a support without the use of screws, clamps or other mounting means, and does not require the use of a tool, the assembly is easily accomplished. The mounting is electrically insulating and is self-centering and self-aligning. The resilience of the mounting provides shock isolation for the speaker, and acts to move the speaker edge upwardly from the support to cause engagement with a grill for proper acoustical operation. The mounting of the speaker on the chassis facilitates assembly thereof in the device in which it is used, including the mounting of the chassis in the housing.

What is claimed is:

1. A mounting structure for supporting the speaker for a radio device from the chassis thereof, with the speaker having a pot and a basket with an edge adapted to engage the grill of the device, and wherein the chassis has a support portion for the speaker with an opening therein, such structure including in combination:

an annular member formed of resilient material having an inner surface adapted to receive the pot of the speaker therein, and effecting a clamping action thereon, said annular member including chord-like sections interspersed with arc-like sections, with said chord-like sections being flexed outwardly by the insertion of the speaker pot therein to store energy to tend to move the speaker pot in a predetermined direction, said member having parts about the exterior thereof which have an extent greater than that of the opening and engage one side of the support portion of the chassis, and a plurality of fingers extending from one end of said annular member and adapted to be inserted through the chassis opening, said fingers each having an outwardly extending hook for engaging the side of the support portion opposite to said one side thereof to hold said member in position thereon, said member being flexible to allow inward movement of said hooks for passage through the chassis opening in the absence of the speaker port therein, with such speaker port rendering said member more rigid to restrain movement of said fingers so that said annular member is held on the chassis.

2. The structure of claim 1 wherein said member and said fingers are molded of plastic electrical insulating material as a single part, and provide shock isolation for the speaker.

3. The structure of claim 1 wherein said annular member has portions adapted to engage the speaker and tending to move the same in the direction away from the chassis so that the speaker edge engages the grill of the device.

4. The structure of claim 3 wherein said annular member includes resilient arms extending from the end of said annular member opposite to said one end for engaging the basket of the speaker to tend to move the speaker in the direction away from the chassis so that the edge of the speaker basket engages the grill of the device.

* * * * *